United States Patent [19]

Poterala

[11] Patent Number: 4,905,381

[45] Date of Patent: Mar. 6, 1990

[54] OPEN TOP COMPACT DRYER OVEN FOR A WEB

[76] Inventor: Robert J. Poterala, 140 Rocky Point, Greenville, S.C. 29615

[21] Appl. No.: 206,853

[22] Filed: Jun. 15, 1988

[51] Int. Cl.[4] ..... F26B 13/00

[52] U.S. Cl. ..... 34/155; 432/59; 34/158

[58] Field of Search ..... 34/156, 155, 154, 23; 432/59

[56] References Cited

U.S. PATENT DOCUMENTS 2,144,919 1/1939 Gautreau ..... 34/156

*Primary Examiner*—Henry A. Bennet

*Attorney, Agent, or Firm*—Cort Flint

[57] ABSTRACT

A compact web dryer oven (A) is disclosed which is heat efficient, may be open for convenient cleaning, and raises automatically under the effects of an explosion to relieve pressure and reduce damage to the oven interior. The oven includes a lower housing (B) and an upper housing (C) which are essentially identical. Each housing includes an air distribution system having a short path and recycle time which includes a hot air discharge blower (H), an air reducing plenum (I), and a redirecting chamber (J) which directs the air in a vertical direction. An elongated air diffuser manifold (K) extends the length of the housing and includes a radial arrangement of pipes (71) and radial air openings (72) which distribute the air (45) in equal parts across the width of web (W). Lower and upper hot air registers (E,F) receive the proportioned air flow. The air registers include spaced tubular members (22) transverse to the air diffuser manifold having an air divider nozzle (G) positioned between each member. A first nozzle (32), second nozzle (34), and third nozzle (42) are defined relative to tubular members (22) and nozzle bodies (G) which accelerate the flow of air in a manner to balance the air currents at the web. Equal but opposite air flows (26,28) are produced by the nozzle body. A spring assembly (96) and pivot (94) provide for release of upper housing (C) upon exertion of an initial lifting force either manually or by explosion.

35 Claims, 5 Drawing Sheets

OPEN TOP COMPACT DRYER OVEN FOR A WEB

BACKGROUND OF THE INVENTION

The invention relates to an improved dryer oven for a textile web and other sheet-like material which is constructed for higher efficiency and cleanability.

In the textile industry, it is common to dry a traveling textile web by passing it through a dryer oven on tenter chains. Other industries also use ovens for drying sheet-like material which travels through the oven. Normally, the ovens are quite large and require that an attendant enter the oven in order for it to be cleaned of waste, dust, and other contaminant particulate matter. In the case of drying fabrics containing volatiles, the residual condensed vapors must often be cleaned from the oven parts, burners, etc. The interior of the typical dryer oven has been constructed as a large box, for example, see U.S. Pat. No. 4,295,284. An average housing for a textile tenter oven is 90 feet in length, 15 feet in width, and 7 feet in height. The oven also includes up to three penthouses on top which house burners, etc., each penthouse is about 10 feet in length, 15 feet in width, and 8 feet in height. The oven housing is not compact and the attendant must enter the large and dark housing in order to clean the parts. The large size and thermal mass in oven structure normally do not allow for the oven to cool down in time for cleaning. Because of the nature of the cleaning operation and the necessity of entering the large housing box, the oven is not cleaned or the attendant often does not perform a thorough job because the oven is still hot or warm, reducing the efficiency and life of the oven. If volatile ovens are not cleaned properly, they can quite easily catch on fire resulting in damage and danger. Explosions quite often result in oven damage. The drying efficiency of the prior art heater ovens is a problem to which little attention has been given. Attention has been somewhat diverted from the problems of cleanability and efficiency and drawn instead to the other mechanical aspects associated with conveying the fabric through the large housing box while contacting opposing sides of the web or sheet material with hot air.

Typically, the textile web drying ovens have consisted of one large housing in which two superposed dryer units are arranged between which the web travels. A plurality of spaced hot air ducts normally are used across the dryer units transverse to the direction of web travel as shown in U.S. Pat. No. 3,739,491. Once the hot air leaves the ducts, it impinges upon the top and bottom of the web. Air control in this area is crucial to the dryer efficiency and performance. Uniform drying of each side of the web is critical. If drying is uneven, streaking or shading of dyed fabrics may result through wicking of the dye. In the case of coated fabrics like latex coated furniture fabrics, the coating will overcure in some areas while undercure in other areas when the drying rate is not uniform. After the fabric is converted to furniture, fabric shading occurs in the areas of overcuring resulting in customer complaints and returned furniture.

Due to the fact that there are many different types of fabric which now need to be dried on the same dryer, many dryers are being made with variable speed blowers to accommodate the different fabrics on the same dryer. However, the existing single nozzle type of air distribution system is still being used in combination with the variable speed blower. The result is the development of eddy currents at certain speeds which result in unbalanced air distribution and uneven drying.

Various structures and methods are used to impinge the hot air upon the traveling web. The single nozzle distribution system is typical of that shown in U.S. Pat. Nos. 4,516,332 and 4,523,391. U.S. Pat. No. 2,144,919 discloses an arrangement of a web drying oven wherein hot air is distributed between transverse ducts, rather than through the ducts as in U.S. Pat. No. 3,739,491. In the '919 patent, the ducts return the air after contacting the traveling web. The ducts are contoured to provide special air flow treatment of the air passing between the ducts to contact the web. In particular, the ducts are shaped to define nozzles which deliver the jets of hot air against the web at angles from 20–30 degrees. U.S. Pat. No. 3,678,599 discloses particular arrangements of air ducts with a perforated concave rib between adjacent ducts. This arrangement is said to stabilize the web moving longitudinally. In this arrangement, the transverse ducts are used for the return of air rather than distribution of hot air. Slot shaped openings are defined at the ends of the rib which direct the hot air in opposite directions. The ducts are said to consist of airfoil sections. The selection of the cross-section of the perforations in the ducts and the vacuum inside the ducts is said to control desired flow conditions. However, this results in a relatively theoretical and complicated determination of air flow characteristics which may not be susceptible of exact determination or practical embodiment. There is also a space between adjacent pairs of ducts in which there is no flow treatment. U.S. Pat. No. 3,060,594 discloses an apparatus for drying webs with hot air or other medium in which provision of a desired air flow pattern is sought to accomplish contact-free and tension-free guiding and drying of webs freely floating within a treatment chamber. In this case, air is discharged from transversely extending ducts and is returned between the ducts.

Various arrangements have been provided for forcing the hot air into the dryer sections. Dual blowers are shown in U.S. Pat. No. 4,137,649 and a single blower is shown in U.S. Pat. No. 4,516,332. Typically, these blowers deliver the air through trapezoidal shaped boxes as illustrated in the aforesaid patents. The air may be heated by a burner or conventional means and taken in by the intake side of the blower. The hot air taken in may also be mixed with the return air from the dryer sections as illustrated in the '332 patent. A single source of heat may be used such as in U.S. Pat. No. 4,551,928, or plural sources of heat may be used such as shown in the '649 patent, one each for the two blowers.

Accordingly, an important object of the invention is to provide a compact dryer oven for a web and the like material which provides balanced hot air distribution for even drying of the web.

Another object of the invention is to provide a web drying oven which is compact and easily cleanable.

Another object is to provide a compact web drying oven having a minimum interior volume so that accumulations of volatile vapors is reduced and a releasable upper housing that will open should an explosion occur to reduce dryer damage.

Another object of the present invention is to provide a dryer oven for a web and like sheet material which is compact and has an upper pivotal housing which may be opened for access to clean the oven without the need of entering the dryer box.

Another object of the invention is to provide a dryer oven for a web and the like material having improved hot air flow distribution for more efficient drying and support of the web traveling through the treatment section of the oven.

Another object of the invention is to provide a dryer oven for a web and the like material which is compact and has a closed circuit air distribution system with a short path which eliminates the use of long supply ducts and increases the number of air changes per minute to provide more efficient and protective use of blower horsepower and a lower temperature differential between supply air and return air, all of which enhances the efficiency of the oven.

Another object of the invention is to provide a dryer oven for a web and the like material having a hot air distribution system which uses a plurality of separate nozzle orifices which balance the air distribution and provide a combination tangential and center lift air flow relative to the traveling web which accelerates drying rates without using high air forces that would tend to push down the pile of pile fabrics and push in the chemical compounds of coated fabrics.

Another object of the invention is to provide a compact dryer oven for a web and the like material in which the interior space and material used within the interior of the oven are both reduced which allows reduced heat mass inside the oven to provide for extremely fast start-up times and low energy consumption.

SUMMARY OF THE INVENTION

A compact dryer oven is disclosed for a traveling web and the like which may be easily cleaned without entering the oven and which is reduced in interior space and structure for more efficient drying. The oven comprises a lower fixed housing and an upper pivotal housing which may be opened to expose both housings for cleaning without entry. The oven has a compact volume to reduce build up of explosive vapors and the upper housing releases in a pivotal action in the event of an explosion. The web travels between the lower and upper housings. Advantageously, each housing includes an identical hot air distribution system so the web is dried evenly on both sides. Each housing includes a hot air discharge device carried in the housing for discharging hot air into the housing. An air diffuser manifold is carried in the housing which extends longitudinally in the direction of web travel. The diffuser manifold receives the discharged hot air and distributes the air radially in equal parts across the width of the web. The air diffuser manifold is carried centrally in an upper part of an air equalizing chamber in the housings which receives the proportioned air flows. A hot air register is carried below the diffuser manifold means across a lower part of the air equalizing chamber. The hot air register includes a plurality of longitudinally spaced tubular members extending laterally across the diffuser manifold and spaced longitudinally in the direction of web travel. An air dividing nozzle is carried between adjacent tubular members for splitting the hot air passing between adjacent tubular members into a first air flow and a second air flow, generally tangential to the web and in opposite directions. The air flows are returned, after traveling a short path, through the tubular members. The air dividing nozzle includes a divider body, and a first nozzle opening between adjacent tubular members upstream of the divider body. There is a second nozzle opening between the divider body and the adjacent tubular members having an area less than the area of the first nozzle opening so that the hot air increases in velocity as it passes through the second nozzle. An expansion zone follows the second nozzle opening having an area greater than the second nozzle to decrease the velocity of the hot air. A third nozzle is created between the divider body and the adjacent tubular members below the expansion zone which has an area less than the area of the expansion zone to increase the velocity of hot air. The series of increasing, decreasing and increasing velocities and pressure of the hot air balances the distribution of hot air delivered through the lower and upper hot air registers so that the web is evenly dried. The tubular members include an air return slot extending longitudinally along the length of the tubular members facing the web for return of air from the first and second air flows. One end of the tubular members is connected to an intake of a heater which supplies heated air to the air discharge device.

Uniform and tangential air flow provides accelerated drying rates for surface sensitive fabrics. The two direction air flow pattern provides a center vacuum which has a lifting action to pile type fabrics. One air jet blows left to right and another air jet blows right to left. Therefore, there is no tendency to force fabric pile in a fixed direction. The air flow also provides advantages to fabrics which have been coated with latex rubber or some other form of chemical compound, the combination tangential flow with center left allows accelerated drying rates without using high air force which would have a tendency to push the chemical compounds into the fabric. Extremely uniform air flow by use of separate nozzle orifices level and balance air distribution on the web. Slotted air return orifices move air from the nozzle air jets directly to the return air tubes in the direction parallel with fabric direction. A special hinged upper housing allows the whole dryer upper section to be lifted to facilitate cleaning and maintenance without requiring operators to enter a dark, usually hot enclosure, thereby reducing the clean-up time. A short circuit air system allows for an extremely reduced air supply and return path without the use of long supply ducts, thereby increasing the number of air changes per minute providing more effective use of fan horsepower and a lower temperature differential between supply air and return air. Elimination of space consuming ducting allows reduced heat mass, thereby providing extremely fast start-up and low energy consumption.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
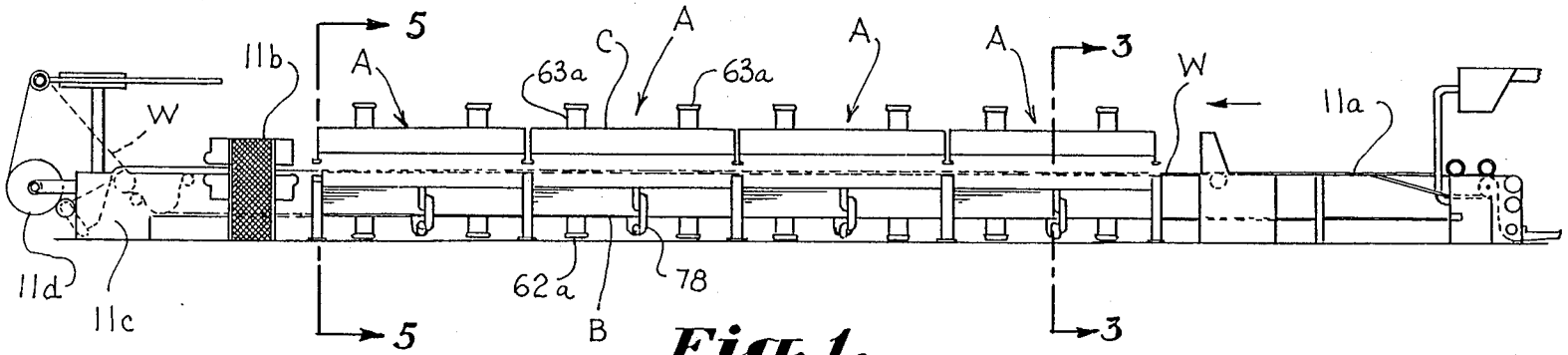
FIG. 1 is a front elevation illustrating a series of dryer ovens constructed in accordance with the invention arranged side by side for drying a continuous web traveling through the ovens.

Referring now in more detail to the drawings, a compact dryer oven is illustrated, designated generally as A, for drying a traveling web W and other sheet-like material which may be easily cleaned without entering the oven and is reduced in interior space and structure for more efficient drying and safety. As can best be seen in FIG. 1, one or more ovens A may be arranged in tandem, four in FIG. 1, for drying the web. The number of ovens used depends on the application being made. It has been found according to the invention that twice the drying may be had with the tandem arrangement as compared to the prior textile ovens having equivalent floor space. In the illustrated application, web W passes through a coater 11*a*, the series of dryer ovens A, and a cooler 11*b*, to a winder 11*c* where the web is taken up on a roll 11*d*. As can best be seen in FIG. 7, the oven comprises a fixed lower oven housing B and a movable upper oven housing C disposed above the lower oven housing. Pivot support means D is provided for pivotally carrying upper oven housing C above lower oven housing B between a closed position (FIG. 3) in which web W travels between the housings for drying, and an open position (FIG. 2) in which housing C is raised and access can be had to an interior, designated generally as 10, of the lower and upper oven housings for cleaning of the interiors. Lower and upper oven housings, B and C, consist of lower and upper housing enclosures 12B and 12C having lower and upper housing openings, designated generally as B, 14B and 14C (FIG. 3). Lower housing opening 14B faces upper housing opening 14C and web W travels across the lower and upper housing openings through the oven. A lower hot air register E is carried generally co-extending across lower housing opening 14B and upper hot air register F is carried generally co-extending across upper housing opening 14C from which hot air, shown by arrows 16, is delivered for contacting and drying lower side 20B and upper side 20C of web W, respectively.

Figure 3:
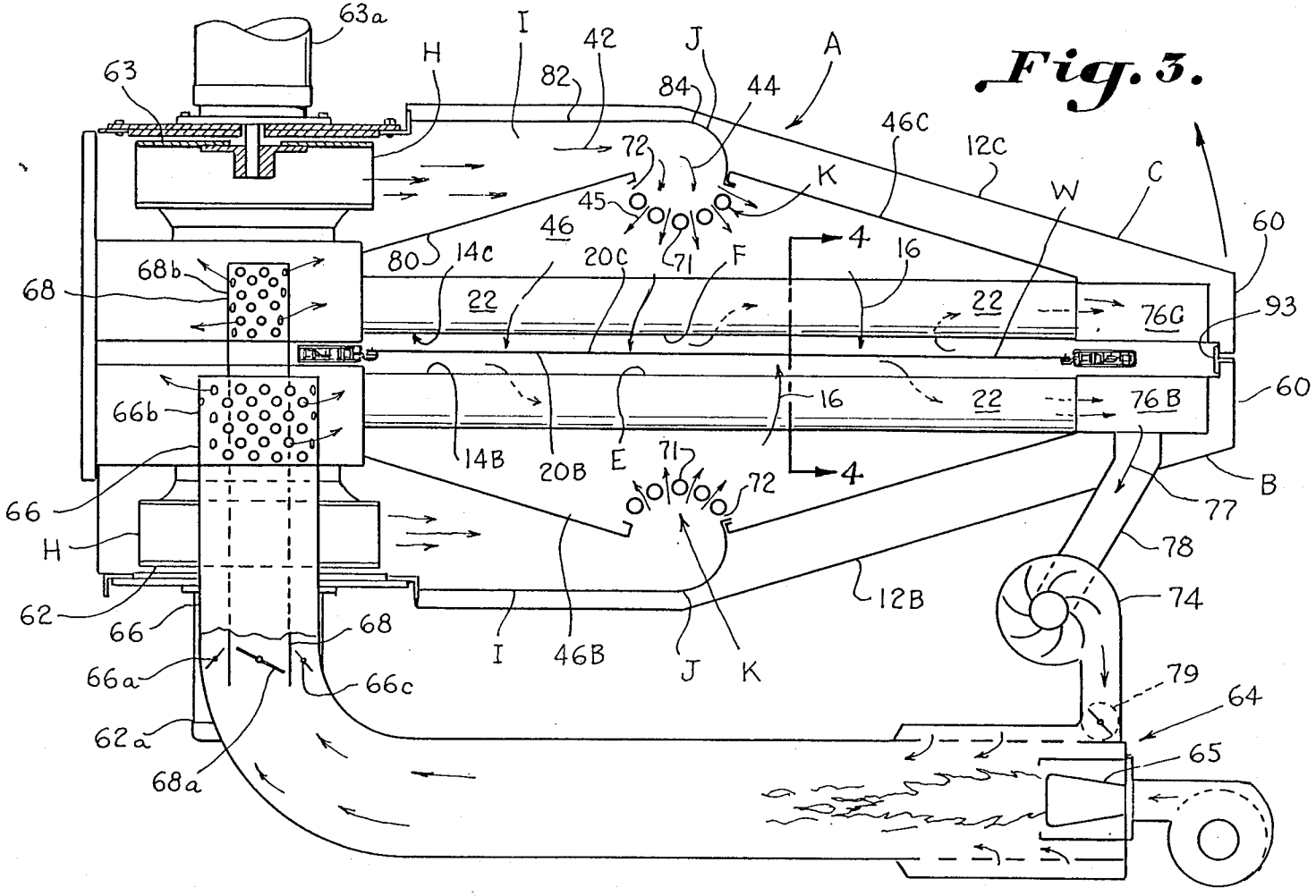
FIG. 3 is a sectional view taken along line 3—3 of FIG. 1.
Figure 4:
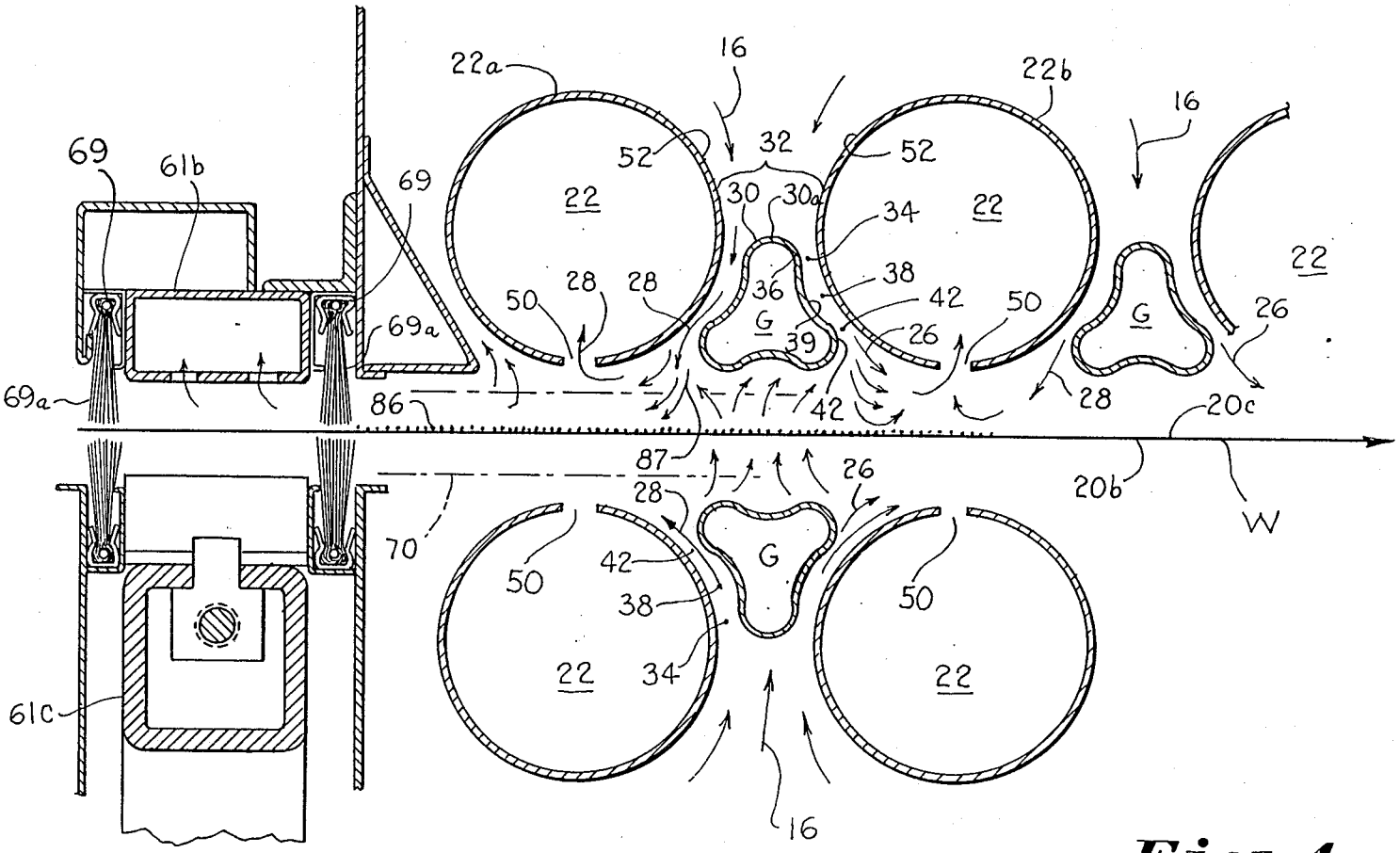
FIG. 4 is a sectional view taken along line 4—4 of FIG. 3 illustrating the air divider assembly of the present invention.

As can best be seen in FIGS. 3 and 4, each lower and upper hot air register E,F includes a plurality of tubular members 22 carried across lower and upper housing openings 14C and 14B spaced longitudinally in the direction of web travel. Tubular members 22 are used to return air which will be explained later. Air dividing nozzle means G is carried between adjacent tubular members 22, i.e. 22*a* and 22*b*, for splitting hot air 16 passing between the adjacent tubular members into a first air flow 26 and a second air flow 28 generally tangential to web W and in opposite directions. Air dividing nozzle means G includes a divider body 30 having a nose 30*a* which splits the hot air flow in half. There is a first nozzle opening 32 between the adjacent tubular members upstream of divider body 30. A second nozzle, designated generally as 34, defined between divider body 30 at a convex part 36 and adjacent tubular members 22*a*, 22*b* having an area less than the area of first nozzle opening 32 so that the hot air increases in velocity passing through nozzle 34. An expansion zone 38 follows second nozzle opening 34 between a concave portion 39 and adjacent tubular members having an area greater than second nozzle 34 to decrease the velocity of the hot air. A third nozzle, designated generally as 40, is defined between said divider body 30 at a convex part 42 and adjacent tubular members 22*a*, 22*b* having an area less than the area of expansion zone 38 to increase again the velocity of the hot air flow. The series of increasing, decreasing and increasing changes in velocity and pressure of the hot air passing through second nozzle 34, expansion zone 38, and third nozzle 40 levels and balance the distribution of hot air delivered through lower and upper hot air registers E and F so that web W is evenly dried. The unique design of the double nozzle 34, 40 air flow system yields a highly leveled air distribution without significant resistance, resulting in high efficiency. This unique design also offers the advantage of automatic nozzle cleaning of the orifices due to the resultant pressure changes which tend to blow out accumulated lint.

Reference will now be had to the entrance of drying air into lower and upper housings B and C. Since the air distribution system is identical for each housing, reference will be made only to upper housing C for purposes of explanation. As can best be seen in FIG. 3, each housing includes hot air discharge means H for discharging hot air into the housing. A reducing plenum means I receives hot air and reduces the air into a generally steady horizontal air flow 42. Air redirecting means J receives the horizontal air flow 42 and directs the horizontal air flow into a generally vertical air flow 44. A diffuser manifold means, designated generally as K, receives the vertical air flow 44 for separating and proportioning the air flow into generally equal parts and directing proportioned air flow 45 into an equalizing chamber 46, i.e. lower and upper equalizing air chambers 46B and 46C, respectively.

Diffuser manifold K distributes a plurality of equal air flows 45 radially across the width of chambers 46B and 46C so that hot air is supplied evenly across the width of web W passing between lower and upper air registers E and F. Means for splitting the proportion air flows 45 includes tubular members 22 and air divider nozzles G spaced across the enclosure openings 14B, 14C, which are the openings of equalizing chambers 46B and 46C, for receiving proportioned air flows 45 and dividing the air flow into first air flows 26 in the direction of web travel and second air flows 28 opposite to the direction of web travel. Uniform and tangential air flow provides accelerated drying rates for surface sensitive fabrics. The two direction air flow pattern provides a center vacuum which has a lifting action to pile type fabrics. Since one air jet blows left to right and another air jet blows right to left, there is no tendency to force fabric pile on a fixed direction. The air flow also provides advantages to fabrics which have been coated with latex rubber or some other form of chemical compound. The combination tangential flow with center lift at 48 allows accelerated drying rates without using high air force which would have a tendency to push the chemical compounds into the fabric.

It has been noted that air equalizing chambers 46B and 46C are carried in lower and upper housing enclosures 14B and 14C surrounding and enclosing lower and upper hot air registers E and F. Longitudinal air return slots 50 are formed along the length of tubular members 22 through which first and second air flows 26 and 28 are exhausted. Tubular members 22 are preferably round and first nozzle 32 is formed by circumferential converging walls 52 of tubular members 22.

Figure 2:
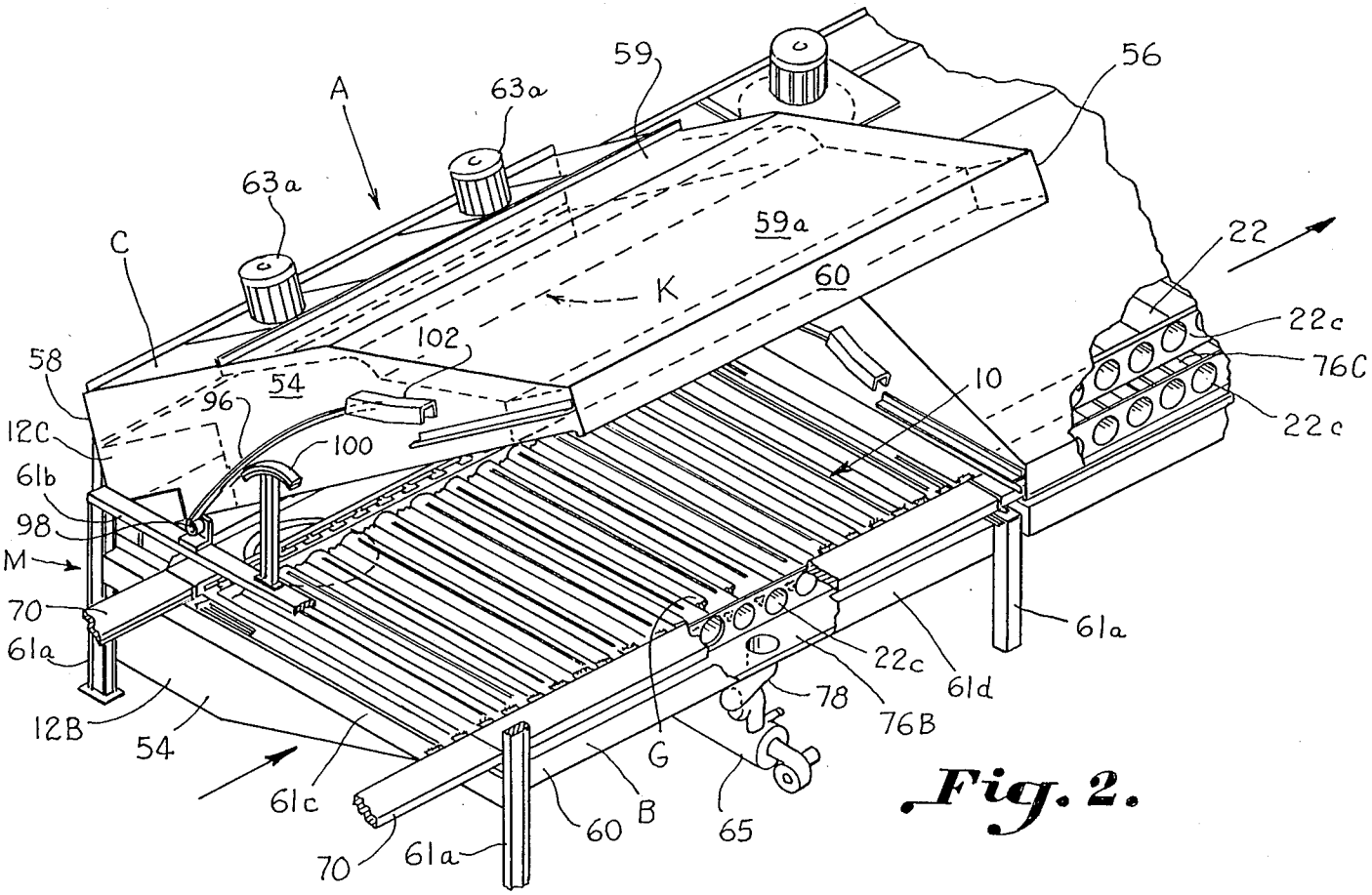
FIG. 2 is a perspective view of a compact dryer oven constructed in accordance with the present invention having a pivotal upper housing.

As can best be seen in FIGS. 2 and 3, each oven housing enclosure 12B, 12C includes a first (front) end wall 54 at which web W enters said oven, a second remote end wall 56 from which the web exits said oven, a back wall 58 integral with the first and second end walls, a top wall 59 integral with the back wall and the end walls which includes an inclined portion **59*a*, and a front wall 60 integral with the top wall and end walls. A frame, designated generally as M, includes legs 61*a*, front end rails 61*b* and 61*c*, and side rails 61*d*** which support housings B and C in a manner which will be more fully explained later.

Air discharge means H includes a pair of first blowers 62 carried in lower housing B and a pair of second blowers 63 carried in upper housing C, and heater means 64 for supplying heated air to each of the blowers 62, 63 for discharge in respective ones of the housings. The blowers are driven by respective electric motors **62*a*,63*a* carried on the housings. Heater means 64 includes a gas burner 65 for heating air and a first heater duct 66 extending into lower housing B between blowers 60 for supplying heated air to the first blowers 60. A second heater duct 68 extends through lower housing B into said upper housing C for delivering heated air to said second blowers 62. First and second heat ducts 66 and 68 are concentric. Second duct 68 is carried within first duct 66 extending through lower housing C into upper housing B exactly between blowers 62. Ducts 66,68 terminate in perforated sections 66*b*,68*b* for distributing air centrally to the blowers. Butterfly valves 66*a* and 68*a* proportion the air flow so it may be equalized to blowers 62, 63, respectively. An efficient end seal system is provided by a flexible brush assembly 69, FIGS. 4 and 5, wherein channel brushes 69*a* are carried by end rails 61*b* at each dryer end 56 and 54 of the end dryers A in the series. The brushes may be carried at the entrance and exits of the end units only, or in the case of one oven, at each end 54, 56. The brushes are constructed of fine gauge wire of stainless steel, brass, or other non-melt materials. Brushes are fitted to meet at the web line. Tenter rails 70 displace brush fibers to form a tight seal around the rail profile. Deflectors 70*a* deflect brush filaments around pin bars 70*b* (or clips on clip tenter) to prevent wear from the pin movement. The web is attached in a conventional manner to pin bars 70*b***. The brushes retain the hot air in the housing.

Diffuser manifold means K includes a radial assembly of elongated cylindrical pipes 71 disposed centrally of equalizing chamber 46 extending longitudinally in the direction of web travel over the length of housing C. The pipes are radially arranged and spaced apart to define radially spaced longitudinally extending slot openings 72 between adjacent pipes through which air is distributed and proportioned equally for equalized distribution across the width of web W. The pipes are preferably hollow pipes having round cross sections. The air return system includes an exhaust blower 74 connected to a blower return duct 76B to which ends 22C of tubes 22 are open and in fluid communication for the return of air. Upper return duct 76C returns air from upper tubes 22 via lower return duct 76B. Return air 77 then goes through duct 78 to exhaust blower 74 and then to burner 65. A diverting valve 79 may be provided to exhaust some return air to ambient rather than recycle. As can best be seen in FIG. 4, air is also drawn off the ends 54,56 through hollow perforated rail **61*b*** attached to suitable suction.

Referring to FIG. 3, redirecting means J includes inclined wall 80, straight wall 82 and a curved wall 84 merging into a curvature of the radially arranged pipes 71 for redirecting air flow vertically through said radial slot openings 72. It is noted that cylindrical diffusers 71 are in a direction parallel to fabric travel. Air then flows from equalizing chamber 46 to nozzles 32 as shown in FIG. 4. The conical surfaces 52 induce the effect of shaping the air flow into a smooth and laminar condition. In the drying and evaporation process with moving web W, a thin air/moisture layer 86 (FIG. 4) travels with the web. Layer 86 substantially inhibits continual heat transfer to the web and further vapor removal by effectig a seal over the web. This layer is broken up by employing air stream 28 tangential to the web which lifts layer 86 and directs it to the vacuum created at slot 50. Secondly, air movement forms a vortex between tubes 22 and nozzle G generally at 87 creating a vacuum. This vacuum helps remove layer 86 and direct it to slot 50. The vacuum also helps to pull vapors within the web to the surface.

The specially shaped nozzle divider G serves to split the air flow into equal streams 26 and 28, which are in opposite direction to each other and due to the curved surface of the return air tubes 22, the discharging air is forced in a direction downward and tangent to the fabric flow which provides both the drying air and, in the case of the lower air system, a support air system. Slots 50 in return air tubes 22 capture this air at the approximate center of the tubes. This provides for a short discharge—drying period after which the hot air is sucked into the tubes 22. Return air tubes 22 are positioned with one end open to the negative pressure of the fan intake.

Figure 6:
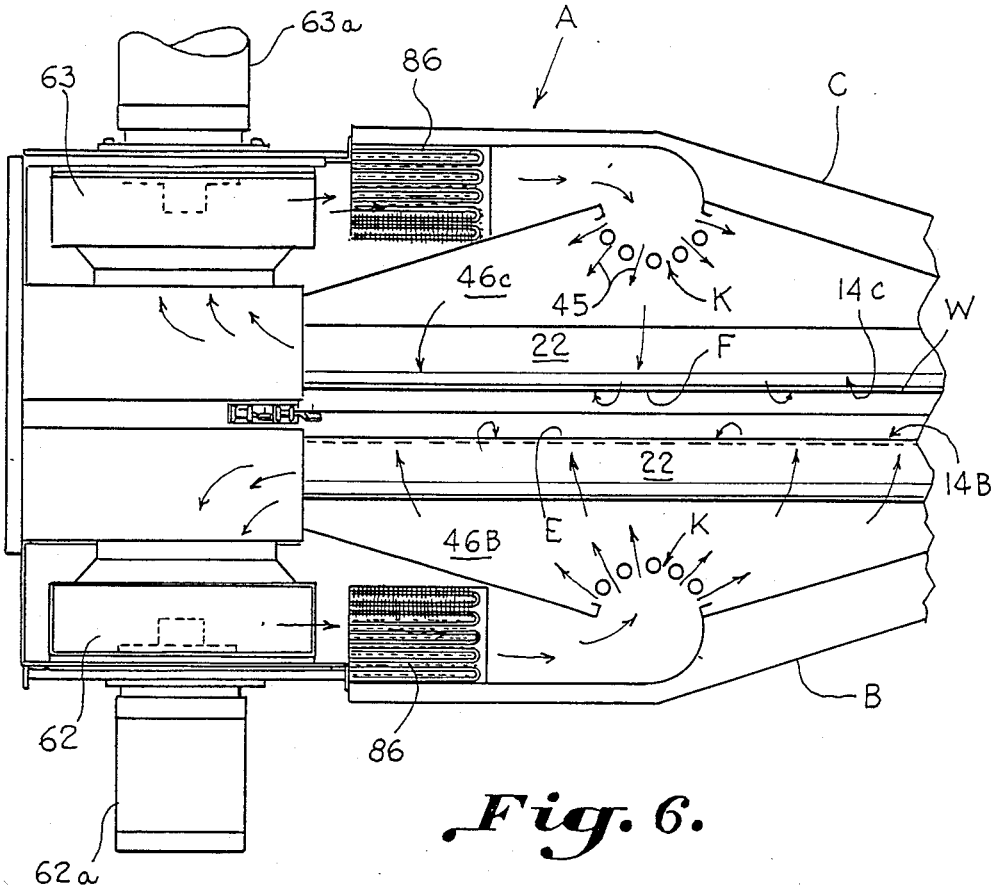
FIG. 6 is a partial section showing another embodiment of an air heater in accordance with the invention.

As can best be seen in FIG. 6, heat may also be applied to the discharge air by electric or steam coils 86 (commercially available) carried by the housings on the discharge sides of blowers 62, 63. Air passing over the hot coils induces heat to the discharge of the blowers and is discharged to the web.

Figure 5:
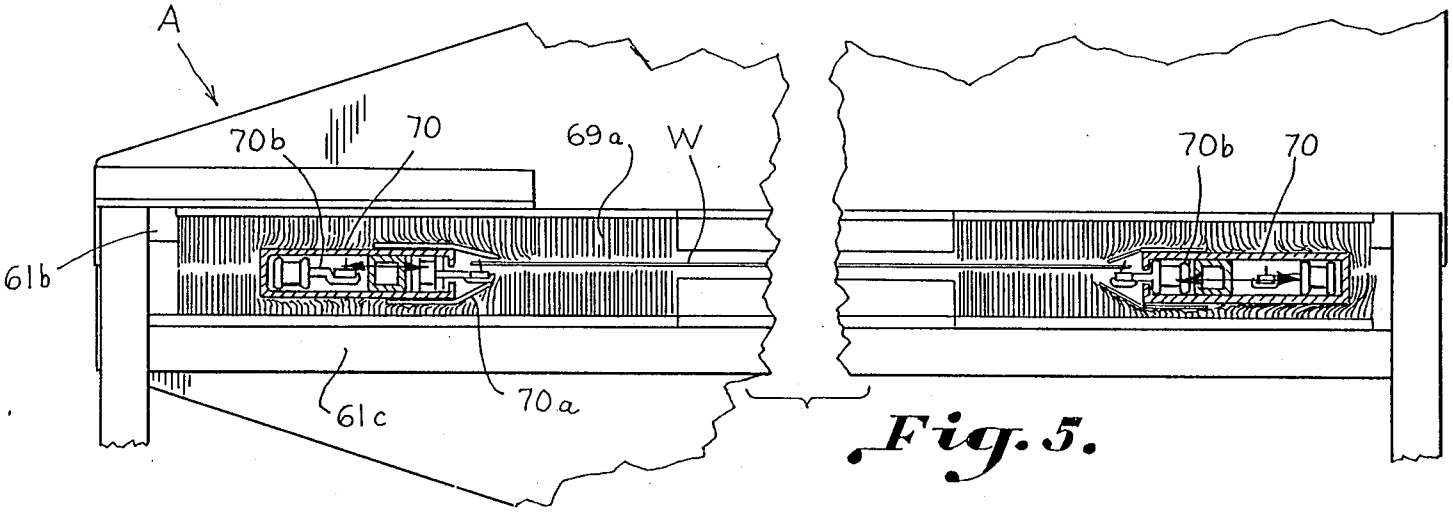
FIG. 5 is a sectional view taken along line 5—5 of FIG. 1.
Figure 7:
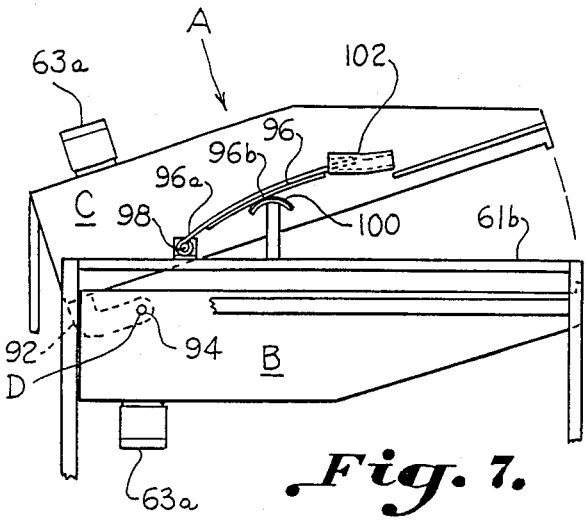
FIG. 7 is a front elevation of a web dryer oven having a fixed lower housing and pivotal upper housing according to the invention.
Figure 8:
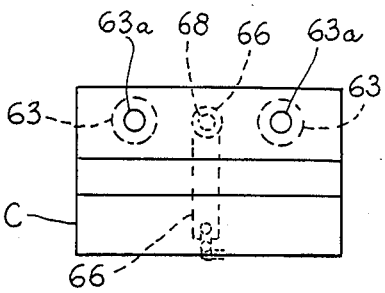
FIG. 8 is a top plan view of the web dryer oven of FIG. 7.

The releasable, pivotal opening of upper housing C, and the mounting of the housings on the frame M will now be described in reference to FIGS. 2, 5 and 7. An L-shaped flange 90 is carried by each end 54,56 of housing C which rests on end rails **61*b* when upper housing C is closed. It is noted that a sealing strip 93 of suitable heat resistant material extends along the joint of front walls 60 of the lower and upper housings when closed to seal against heat loss. Pivot means D includes a pivot arm 92 affixed to housing C and pivotally attached by pivot pin 94 to lower housing B. Lower housing B is affixed to frame M in any suitable manner such as welding, in an under slung manner. It can be seen then that the interior of housings B and C is greatly reduced in its volume compared to the prior textile dryer and the like ovens. This minimized volume has less tendency for an explosion since the amount of volatile vapors is reduced. However, in the event of an explosion, upper housing will release from its closed position and pivot upwards if sufficient pressure exists to relieve the effects of the explosion and minimize damage to the oven. For this reason, upper housing is provided with a release means N in connected between the housing and frame M which yields to pressure allowing housing C to pivot upwards. Release means N includes a leaf spring 96 having one end 96***a* pivotally attached to end rail 61*b* at a pivot 98. A medial portion 96*b* of the spring slides on a rider 100 affixed to end rail 61*b*. A free end 96*c* is received in a retainer 102 carried by end 54 of housing C. Spring 96 applies a biasing force which assists in the release and raising of the housing requiring only about 50 lbs force to open the housing. Thus, the housing will release and pivot open before the forces of an explosion will damage the interior parts of the oven.

Thus, it can be seen that a highly advantageous construction can be had according to the invention for evenly drying a web and facilitating oven cleaning. Extremely uniform air flow is achieved by use of three separate nozzle orifices 32, 38, and 40 which balance air distribution to web W. Air return slots move air from the nozzle air jets directly to return air tubes in the direction parallel with fabric direction. Prior machines used an open channel whereby the air moved perpendicular to fabric travel, this provides that as the air picked up moisture, it cooled rapidly and was traversed across the fabric, subjecting the edges to a different drying condition than was at the center. Single side mounted fans with central air supply provide the advantage of saving space within the dryer enclosure, the center distributor assures that this air is uniformly distributed to each dryer side. Previous single side designs feed air distribution to only one side. A special hinged housing assembly allows the whole dryer upper housing to be lifted to facilitate cleaning and maintenance without requiring operators to enter a dark, usually hot enclosure, reducing the clean-up time. A short path air system allows for an extremely reduced air supply and return path without the use of long supply ducts, thereby increasing the number of air changes per minute providing more effective use of fan horsepower and a lower temperature differential between supply air and return air. Reduced internal material, i.e., elimination of space consuming ducting, allows reduced heat mass, thereby providing extremely fast start-up and low energy consumption.

While a preferred embodiment of the invention has been described using specific terms, such description is for illustrative purposes only, and it is to be understood that changes and variations may be made without departing from the spirit or scope of the following claims.

What is claimed is:

1. A compact dryer oven for drying a traveling web comprising:

a fixed lower oven housing;

a movable upper oven housing disposed above said lower oven housing having an closed position for drying said web and a raised position for access to the interior of said housings;

each said lower and upper oven housing having a hot air distribution system which includes;

hot air discharge means for discharging hot air, air reducing plenum means for receiving said hot air and reducing said air into a generally steady horizontal air flow, air redirecting means receiving said horizontal air flow for directing said horizontal air flow into a generally vertical air flow, air diffuser manifold means receiving said vertical air flow for separating and proportioning said air flow into generally equal parts and directing said proportioned air flow into an equalizing chamber, air divider means spaced across said equalizing chamber for receiving said proportioned air flow and dividing said air flow into a plurality of first air flows in the direction of web travel and a plurality of second air flows opposite to the direction of web travel, and said air divider means of said upper and lower oven housings facing one another and receiving said web between said air divider means as said web travels through said oven for even drying of both sides of said web.

2. The apparatus of claim 1 wherein said air discharge means includes:

first air blower means carried in said lower housing and second air blower means carried in said upper housing, and heater means for supplying heated air to said blower means for discharge in respective ones of said housings.

3. The apparatus of claim 2 wherein said heater means includes a first heater duct extending into said lower housing for supplying heated air to said first blower means, and a second heater duct extending through said lower housing into said upper housing for delivering heated air to said second blower.

4. The apparatus of claim 3 wherein said first blower means includes a first pair of air blowers carried in said lower housing with a first space in between, said first heater duct terminating centrally in said first space; and said second blower means including a second pair of air blowers with a second space in between, and said second heater duct terminating centrally in said second space.

5. The apparatus of claim 4 wherein said first and second heater ducts are concentric, said second duct being carried within said first duct extending through said lower housing.

6. The apparatus of claim 1 wherein said air diffuser manifold means includes a manifold assembly disposed centrally in said equalizing chamber extending longitudinally in the direction of web travel, said manifold having a plurality of radial slot openings radially arranged and spaced apart through which air is distributed and proportioned equally for equalized distribution across the width said web.

7. The apparatus of claim 6 wherein said air diffuser manifold means includes a radial assembly of generally round pipes being radially arranged and spaced apart to define said radial slot openings.

8. The apparatus of claim 6 whereinsaid air redirecting means includes a curved wall merging into a curvature of said radial assembly of pipes for redirecting said air flow vertically through said radial slot openings.

9. The apparatus of claim 6 wherein said air divider means includes a plurality of tubular members extending across said lower and upper oven housings transverse to said longitudinally extending radial slot openings, and a divider nozzle between adjacent tubular members which splits the air flow into said first and second air flows which are generally equal and opposite air flows tangent to said web, said first and second air flows in said upper housing providing drying air for said web and said first and second air flows in said lower housing providing drying air and support air for said web.

10. The apparatus of claim 1 wherein said air divider means includes a plurality of tubular members extending across said lower and upper housings transverse to said web travel, and a divider nozzle between adjacent tubular members which splits the air flow into said first and second air flows which are generally equal and opposite air flows tangent to said web, said first and second air flows in said upper housing providing drying air for said web and said first and second air flows in said lower housing providing drying air and support air for said web.

11. The apparatus of claim 10 wherein said divider nozzle includes nozzle means for firstly increasing the velocity and pressure of said first and second air flows, secondly decreasing the velocity and pressure of said first and second air flows, and thirdly increasing the velocity and pressure of said first and second air flows passing between said divider nozzle in a manner that the distribution of air is leveled and balanced prior to contacting said web for even web drying.

12. The apparatus of claim 10 including:

a first nozzle defined upstream from said divider nozzle which includes a reducing zone between adjacent tubular members leading into said nose portion;

said divider nozzle including a nose portion which splits said air flow in half, second nozzle between said divider nozzle and said tubular members having an area less than the area of said first nozzle which increases the velocity of said air;

an expansion zone defined between said divider nozzle, a second nozzle defined between said divider nozzle and said tubular members having an area greater than said first nozzle for decreasing the velocity of said air; and a third nozzle defined between said divider nozzle and said tubular members having an area less than said expansion zone for increasing the velocity of said air.

13. The apparatus of claim 10 wherein said tubular members include an air return slot extending longitudinally along the length of said tubular members generally facing said web for return of air from said first and second air flows, and one end of said tubular members being connected to an intake of a heater which supplies heated air to said air discharge means.

14. The apparatus of claim 1 including high temperature air seal sealing a joint between said upper and lower housings at first and second ends of said housings at which said web enters and exits, respectively, and said air seal including high temperature metal brushes carried at said joint between which said web passes which prevents the escape of hot air from said oven.

15. A compact dryer oven for a traveling web and the like which may be easily cleaned without entering the oven and which is reduced in interior space for more efficient drying, said oven comprising:

a fixed lower oven housing;

a movable upper oven housing disposed above said lower oven housing;

pivot means for pivotally carrying said upper oven housing above said lower oven housing between a closed position for web drying and an open position in which said upper housing is raised for access to an interior of said lower and upper oven housings for cleaning of said interior;

said lower and upper oven housings consisting of lower and upper housing enclosures having lower and upper housing openings formed in said respective lower and upper housings, said lower housing opening facing said upper housing opening, and said web traveling across said lower and upper housing openings through said oven;

a lower hot air register carried generally co-extending across said lower housing opening and an upper hot air register carried generally co-extending across said upper housing opening from which hot air if delivered for contacting and drying the sides of said web; and each said oven housing enclosure includes a first end wall at which said web enters said oven, a second remote end wall from which said web exits said oven, a back wall integral with said first and second end walls, a top wall integral with said back wall and said end walls, and a front wall means for integrally joining said top wall and said end walls.

16. The apparatus of claim 15 including release means connected to said upper housing for assisting in the raising of said upper housing to said open position upon an initial lifting force being exerted on said upper housing.

17. The apparatus of claim 16 wherein said release means includes biasing means connected to said upper housing which assists in the raising of said housing when said initial lifting force is imparted to said housing, said initial force corresponding to a prescribed pressure within said housing.

18. The oven of claim 15 wherein each said lower and upper hot air registers includes:

a plurality of tubular members carried across said lower and upper housing openings spaced longitudinally in the direction of web travel; and air dividing nozzle means carried between adjacent tubular members for splitting said hot air passing between said adjacent tubular members into a first air flow and a second air flow generally tangential to said web and in opposite directions.

19. The oven of claim 18 wherein said air dividing nozzle means includes:

a divider body;

a first nozzle opening between said adjacent tubular members upstream of said divider body;

a second nozzle opening between said divider body and said adjacent tubular members having an area less than the area of said first nozzle opening so that said hot air increases in velocity;

an expansion zone following said second nozzle opening having an area greater than said second nozzle to decrease the velocity of said hot air;

a third nozzle between said divider body and said adjacent tubular members having an area less than the area of said expansion zone to increase the velocity of hot air; and the series of increasing, decreasing and increasing velocities of hot air balancing the distribution of hot air delivered through said lower and upper hot air registers so that web is evenly dried.

20. The oven of claim 15 including:

an air equalizing chamber carried in said lower and upper housing enclosures surrounding and enclosing said lower and upper hot air registers;

air diffuser manifold means carried in an upper central position of said equalizing chamber extending transverse to said tubular members in said hot air registers for distributing hot air in equal parts across the width of said hot air registers and web traveling across said hot air registers; and air discharge means for receiving said exhaust air returned from said tubular members and supplying said exhaust air together with heated air to said diffuser manifold means.

21. The oven of claim 18 including longitudinal air return slots formed along the length of said tubular members through which said first and second air flows are exhausted.

22. The oven of claim 19 wherein said tubular members are round and said first nozzle is formed by circumferential converging walls of said tubular members.

23. A compact dryer oven for a traveling web and the like which may be easily cleaned without entering the oven and which is reduced in interior space for more efficient drying, said oven comprising:

housing means;

hot air discharge means carried in said housing means for discharging hot air into said housing means;

air diffuser manifold means carried in said housing means extending longitudinally in the direction of web travel, said air diffuser manifold means receiving said discharged hot air for distributing said air in generally equal parts across the width of said web; and a hot air register carried below said air diffuser manifold means which includes a plurality of longitudinally spaced tubular members extending transverse to said diffuser manifold means and said direction of web travel, and air dividing nozzle means carried between adjacent tubular members for splitting said hot air passing between said adjacent tubular members into a first air flow and a second air flow generally in opposite directions.

24. The oven of claim 23 wherein said air dividing nozzle means includes:

a divider body;

a first nozzle opening between said adjacent tubular members upstream of said divider body;

a second nozzle opening between said divider body and said adjacent tubular members having an area less than the area of said first nozzle opening so that said hot air increases in velocity;

an expansion zone following said second nozzle opening having an area greater than said second nozzle to decrease the velocity of said hot air;

a third nozzle between said divider body and said adjacent tubular members having an area less than the area of said expansion zone to increase the velocity of hot air; and said series of increasing, decreasing and increasing velocities of hot air balancing the distribution of hot air delivered through said lower and upper hot air registers so that web is evenly dried.

25. The apparatus of claim 23 including air return slots extending longitudinally along the length of said tubular members generally facing said web for return of air from said first and second air flows, and one end of said tubular members being connected to an intake of a heater which supplies heated air to said air discharge means.

26. The oven of claim 23 including:

an air equalizing chamber carried in said lower and upper housing enclosures surrounding and enclosing said lower and upper hot air registers;

air diffuser manifold means carried in an upper central position of said equalizing chamber extending transverse to said tubular members in said hot air registers for distributing hot air in equal parts across the width of said hot air registers and web traveling across said hot air registers; and air discharge means for receiving said exhaust air returned from said tubular members and supplying said exhaust air together with additional heated air to said air diffuser manifold means.

27. The apparatus of claim 23 wherein said air discharge means includes:

first blower means carried in said lower housing and second blower means carried in said upper housing, and heater means for supplying heated air to said blowers for discharge in respective ones of said housings; and heater means for heating air discharged from said blower means.

28. The apparatus of claim 27 wherein said first blower means includes a first pair of blowers spaced between an entrance and exit end of said lower housing; said second blower means includes a second pair of blowers arranged between an entrance and exit end of said upper housing, and said first and second pairs of blowers being carried adjacent a side wall of said lower and upper housings for discharging air across said housings from said side.

29. The apparatus of claim 27 wherein said heater means includes a first heater duct extending into said lower housing for supplying heated air to said first blower means, and a second heater duct extending through said lower housing into said upper housing for delivering heated air to said second blower means; and said first and second heater ducts are concentric, said second duct being carried within said first duct extending through said lower housing.

30. A compact dryer oven for drying a traveling web and the like comprising:

a pair of superposed oven housings between which said web travels for drying;

each said housing including an air supply and return circuit having a short path providing an increased number of air changes per minute and a lower temperature differential between supply air and return air, said air supply and return circuit including:

hot air discharge means for supplying hot air, air diffuser means disposed above said traveling web for proportioning said hot air into generally equal air flows across the width of said web, an air equalizing chamber in which said diffuser means is carried near an upper portion of said chamber, air nozzle means carried in a lower portion of said chamber extending transversely to said diffuser means for dividing said equal air flows into a plurality of first and second air flows wherein said first air flow occurs in the direction of travel of said web, and said second air flow occurs in an opposite direction to said web travel, air return means disposed in close proximity to said nozzle means for evacuating said first and second air flows shortly after contacting said web, and said air re turn means being connected to a suction side of hot air discharge means.

31. The apparatus of claim 30 wherein said nozzle means comprises a plurality of tubular members extending transverse and next adjacent to said tubular members being spaced along the direction of web travel, a nozzle body carried between adjacent tubular members to divide said equal air flows into said first and second air flows, said tubular members containing a bottom slot spaced generally equidistantly from said nozzle body and in close proximity thereto for exhausting said first and second air flows as return air, and one end of said tubular members being attached to a return duct for returning at least a portion of said air to said hot air discharge means.

32. The apparatus of claim 30 wherein said pair of housings comprises a lower housing and an upper housing, said lower housing having said first and second air flows which dry and support said web vertically as it passes between said housings, and said upper housing having said first and second air flows that dry and lift said web.

33. The apparatus of claim 30 wherein said pair of housings includes a lower fixed housing and an upper movable housing, means for movably supporting said upper oven above said lower oven for movement between a closed position for drying said web and a raised position for cleaning said ovens and for relieving excessive pressure in said oven resulting from explosion of volatile vapors, and including release means connected to said upper housing for releasing said housing to open and raise upon a prescribed pressure existing in said oven.

34. The apparatus of claim 30 wherein said equalizing chamber includes upper inclined walls tapering from said air diffuser means toward said tubular members for maintaining said equal air flows generally compressed and equal.

35. The apparatus of claim 34 wherein said housing includes a generally corresponding contoured wall above said inclined wall of said chamber minimizing the space in between.

* * * * *